US006032826A

United States Patent [19]

Libit et al.

[11] Patent Number: 6,032,826

[45] Date of Patent: Mar. 7, 2000

[54] CUP HOLDER

[76] Inventors: Jeanne E. Libit, 2322 N. Upton St., Arlington, Va. 22207; Sidney M. Libit, 2525 Gulf of Mexico Dr., Longboat Key, Fla. 34228

[21] Appl. No.: 09/215,171

[22] Filed: Dec. 18, 1998

[51] Int. Cl.[7] ..... B65D 3/28

[52] U.S. Cl. ..... 220/738; 220/739; 229/400

[58] Field of Search ..... 220/737, 738, 220/739, 903, 592.17, 592.23; 229/400, 403

[56] References Cited

U.S. PATENT DOCUMENTS

| | | | |
|---|---|---|---|
| 1,866,805 | 7/1932 | Haywood | 220/737 X |
| 1,910,168 | 5/1933 | Jacobs | 220/737 X |
| 2,661,889 | 12/1953 | Phinney | 220/903 X |
| 3,337,109 | 8/1967 | Shumrak | 220/738 |
| 5,143,247 | 9/1992 | Gavle | 229/400 X |
| 5,205,473 | 4/1993 | Coffin, Sr. | 220/739 X |
| 5,425,497 | 6/1995 | Sorensen | 220/738 |
| 5,454,484 | 10/1995 | Chelossi | 220/738 |
| 5,746,372 | 5/1998 | Spence | 220/738 X |
| 5,842,633 | 12/1998 | Nurse | 220/737 X |
| 5,857,615 | 1/1999 | Rose | 220/739 X |
| 5,868,310 | 2/1999 | Leszczynski | 220/738 X |

*Primary Examiner*—Steven Pollard

*Attorney, Agent, or Firm*—Jacobson, Price, Holman & Stern, PLLC

[57] ABSTRACT

A cup holder for use with beverage containers which enables the beverage consumer to more effectively grasp and hold the combined holder and container when consuming a beverage from the container, more effectively stabilize the beverage container when supported on a supporting surface and provide insulation between the exterior of the beverage container and the hand of the beverage consumer. The cup holder is constructed in the form of a planar blank of recyclable material which can be quickly and easily formed into a sleeve and set up without the use of glue, easily assembled onto a cup or beverage container without requiring manual dexterity, easily removed from the cup and recycled when combined with the cup or separated therefrom.

17 Claims, 7 Drawing Sheets

CUP HOLDER

BACKGROUND OF THE INVENTION

1. Field of the Invention

The present invention generally relates to a cup holder for use with beverage containers such as those containing hot or cold liquids. The cup holder includes unique structural features which enables a beverage consumer to more effectively grasp and safely hold the combined holder and container when consuming a beverage from the container. The cup holder more effectively stabilizes the beverage container when supported on a supporting surface, provides insulation between the exterior of the beverage container and the hand of a beverage consumer and enables containers of recyclable material to be used for hot liquids. The cup holder is constructed as a planar blank of recyclable material which simplifies manufacture of the cup holder and eliminates the use of glue and the step of applying glue when making or assembling the cup holder. The cup holder can be quickly and easily assembled onto the beverage container and removed therefrom without requiring skilled manual dexterity.

2. Description of the Prior Art

Disposable beverage containers of tapered cylindrical configuration for hot and cold beverages have become universally used by carryout or fast food restaurants and similar establishments. Hot beverages are usually dispensed into a polystyrene cup which protects the hand of a beverage consumer when holding the cup. Cold beverages are usually dispensed in a paper cup which may be coated to render the cup less prone to leakage. Presently available beverage cups or containers are tapered from a larger upper end to a smaller lower end for nesting purposes which renders the containers somewhat unstable when placed on a supporting surface due to the small diameter of the lower end of the cup. The smaller lower end of the cup provides an unstable support especially when the cup is substantially full inasmuch as only a slight tilting of the beverage cup or container will cause spillage of the beverage from the cup or container.

Various efforts have been made to improve the handling of beverage containers by beverage consumers including the provision of handle tabs which can be folded out from the peripheral side wall of a beverage container and insulating tubes mounted on the exterior of the beverage container and tapering in the same manner as the tapered configuration of the beverage container. While such known devices alleviate somewhat the problem of discomfort caused by a beverage consumer grasping a very hot beverage cup or container, such devices do not improve the stability of the beverage cup when placed on a supporting surface and are not readily assembled with the beverage container at the point of use.

The following U.S. patents disclose tapered sleeve-type insulating holders or attachments to beverage cups or containers.

U.S. Pat. No. 5,205,473

U.S. Pat. No. 5,425,497

U.S. Pat. No. 5,425,497 discloses a cup holder which can be stored flat and assembled by a user to fit around the cup which increases the gripability and insulation value of the cup. However, to assemble the cuts 32 and 38 when assembling the holder onto the beverage cup requires considerable manual dexterity in aligning the cuts and does not alter the stability of the cup when placed on a supporting surface.

U.S. Pat. No. 5,205,473 discloses a corrugated cup construction for insulation purposes with the preferred holder being a corrugated tubular sleeve on a cup which can be folded flat for storage. The structure in this patent also fails to enhance the stability of the cup.

The prior art does not disclose a cup holder for a beverage cup or container which provides insulation characteristics, more effective gripping and safe holding of the beverage cup or container and increases the stability of the beverage cup or container when it is placed on a supporting surface. The prior art also fails to disclose a cup holder formed from a planar blank which can be die cut in a single operation and which does not employ glue or glueing operation during manufacture thereby simplifying the manufacture of the cup holder thus reducing the cost and enhancing the recyclable characteristics of the cup holder.

SUMMARY OF THE INVENTION

The cup holder of this invention includes a longitudinally extending sleeve having an opening in the top which enables a beverage cup or container to be inserted with the bottom end of the cup entering the opening in the top of the cup holder. The cup then descends into the cup holder until the flange or lip at the upper end of the beverage cup or container engages the top edges of the cup holder or the taper of the cup limits insertion into the holder. The vertical height of the cup holder is greater than the vertical height of the beverage cup or container or engages the cup so that the lower end of the cup is spaced above the lower edges of the cup holder when the lower edges of the cup holder engage a support surface laterally outwardly of the periphery of the bottom of the beverage cup or container thereby stabilizing the beverage cup or container when supported on a supporting surface.

The cup holder is constructed from a planar blank of cardboard, corrugated board or the like provided with a transverse slit at a central portion thereof. A fold line extends outwardly from each end of the slit to enable the planar blank to be folded into overlying halves along a transverse center line. Longitudinal fold lines at the ends of the slit enable the opposite side edges of the folded blank to be moved inwardly to open the folded blank by moving the slit edges outwardly to form a sleeve. Either or both side edges of the folded blank is provided with structure to facilitate the opposed side edges being moved inwardly. Such structures include laterally extending arms at the upper edge of the folded blank which contain the fold lines or a lateral extension either notched or straight at the upper edge of the folded blank which contain the fold lines to enable the folded blank to be moved to form a sleeve. Fold lines may be provided longitudinally of the folded blank at the center thereof to define fold lines extending longitudinally at the central portion of the outwardly deflected portions of the blank when forming the sleeve for receiving the beverage cup or container. The cup holder is formed and assembled onto a cup without using glue which simplifies manufacture and reduces cost of the cup holder and without requiring a high degree of manual dexterity.

Accordingly, it is an object of the present invention to provide a cup holder for a beverage cup or container which will protect the hand when gripping the cup to consume the beverage and stabilize the cup when the cup is inserted into the cup holder and placed on a supporting surface such a tabletop surface, or a movable supporting surface such as a food supporting tray in an airplane, automobile, railroad car or the like.

Another object of the invention is to provide a cup holder having a lateral outward projection or projections to engage upper surface areas of a hand holding the cup which prevents the cup from slipping out of the hand when holding the cup or consuming beverage from the cup.

A further object of the invention is to provide a cup holder in the form of a flat one-piece blank having a transverse central slit and a transverse fold line extending to the side edges of the blank at each end of the slit by which the blank can be folded into overlying halves. The side edges of the folded blank are then moved toward each other to open the slit to form a sleeve to enable a cup to be inserted bottom first into the upper end of the cup holder.

A still further object of the invention is to provide a cup holder having a length that enables the bottom edges to project beyond the bottom of the cup and engage a supporting surface in laterally spaced relation to the periphery of the bottom of the cup thereby, in effect, increasing the size of the supporting surface engaged by the cup holder thereby stabilizing the cup that is supported in the cup holder. The weight of the cup and the beverage in the cup exerts a downward force on the cup holder with the lower ends of the cup holder engaging a support surface being biased outwardly to cause the upper edges of the slit opening to move inwardly about the fold line to provide a gripping engagement of the slit edges at peripherally spaced areas on the beverage cup.

Still another object of the invention is to provide a cup holder constructed of corrugated paper or cardboard material, pressed cardboard or other cardboard material, heavy paper or the like without the use of glue and without a glue applying step when making the cup holder which renders the cup holder inexpensive for disposability and also recyclable with the cup holder enabling beverage cups or containers of recyclable material to be more effectively used under more circumstances since it no longer will be necessary to provide polystyrene cups for hot beverages.

Yet a further object of the invention is to provide a cup holder in accordance with the preceding objects in which the lower edge of the cup holder may be provided with diametrically opposed tabs or projections, defined by right angle slits, which project beyond the periphery of the bottom edge of the cup holder when the cup holder is formed into a sleeve by moving the side edges of the cup holder toward each other.

Yet another important object of the invention is to provide a cup holder in accordance with the preceding objects which is easy to assemble onto a beverage cup or container and does not require a high degree of manual dexterity and can be constructed so that a user can save the cup holder for subsequent use with another beverage cup or container.

These together with other objects and advantages which will become subsequently apparent reside in the details of construction and operation as more fully hereinafter described and claimed, reference being had to the accompanying drawings forming apart hereof, wherein like numerals refer to like parts throughout.

DESCRIPTION OF THE PREFERRED EMBODIMENTS

Figure 1:
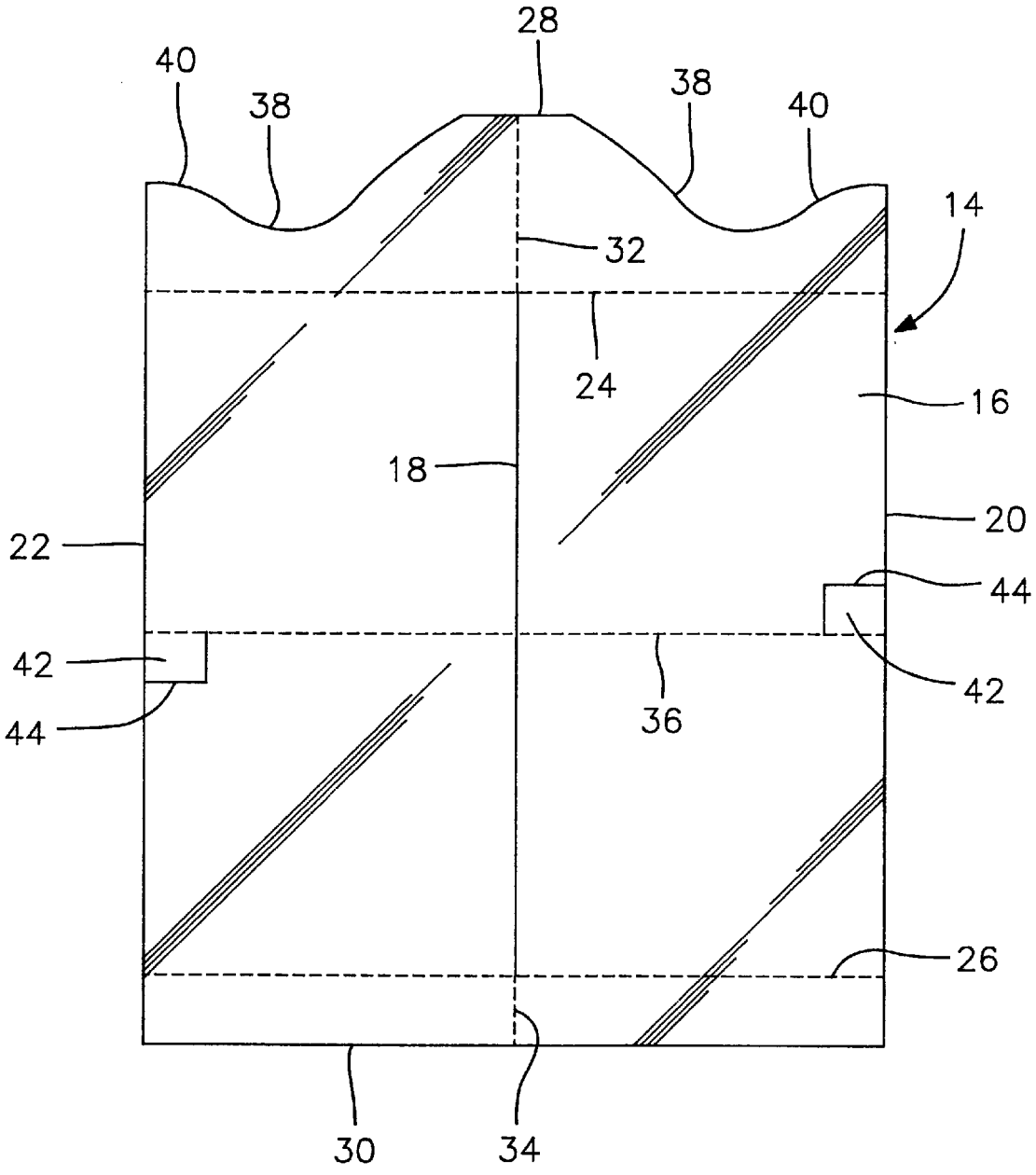
FIG. 1 is a plan view of a planar blank forming one embodiment of the cup holder of the present invention.

Although only preferred embodiments of the invention are explained in detail, it is to be understood that the invention is not limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

Figure 2:
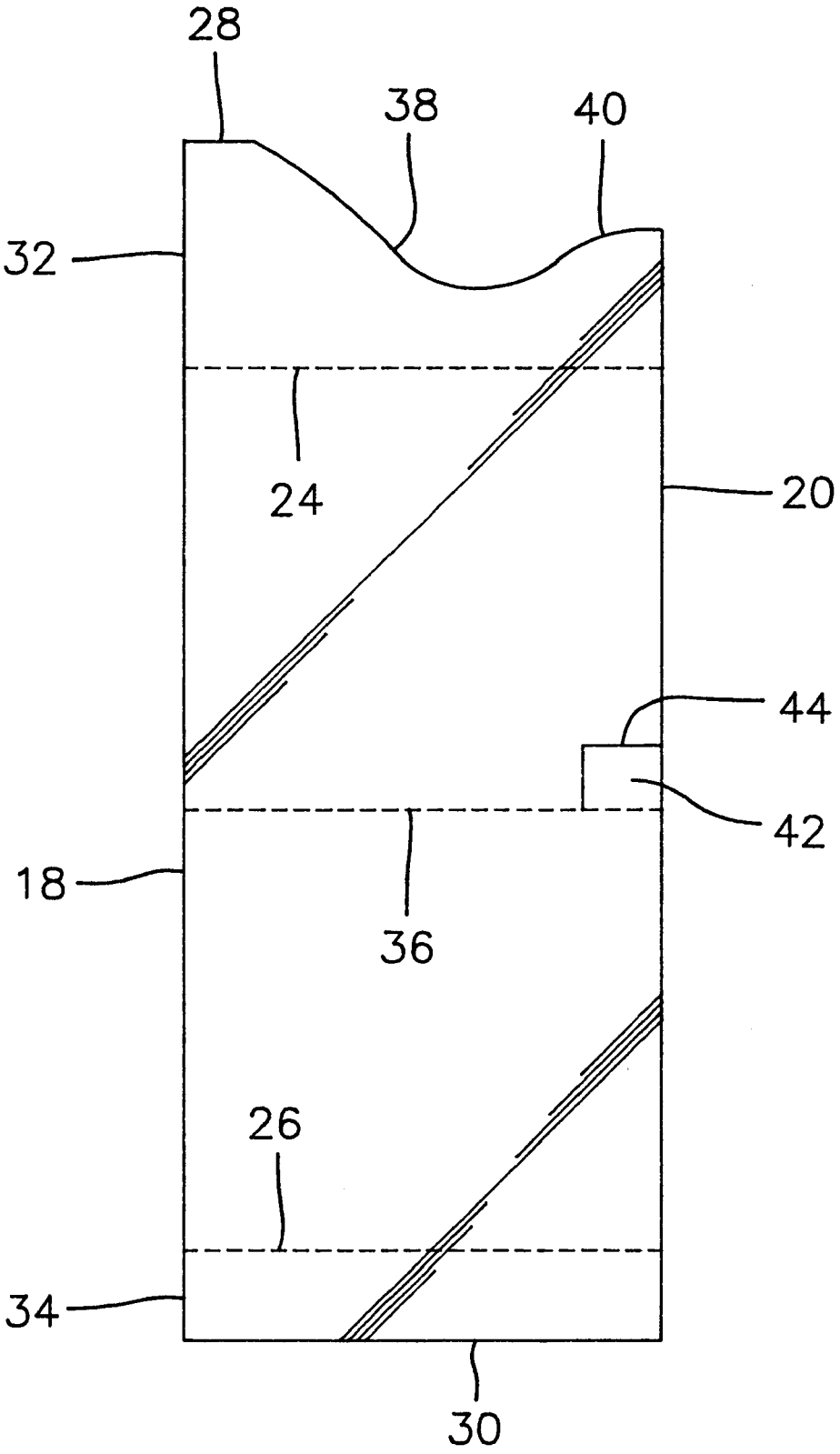
FIG. 2 is a plan view of the blank folded along a center line into two identical halves.
Figure 3:
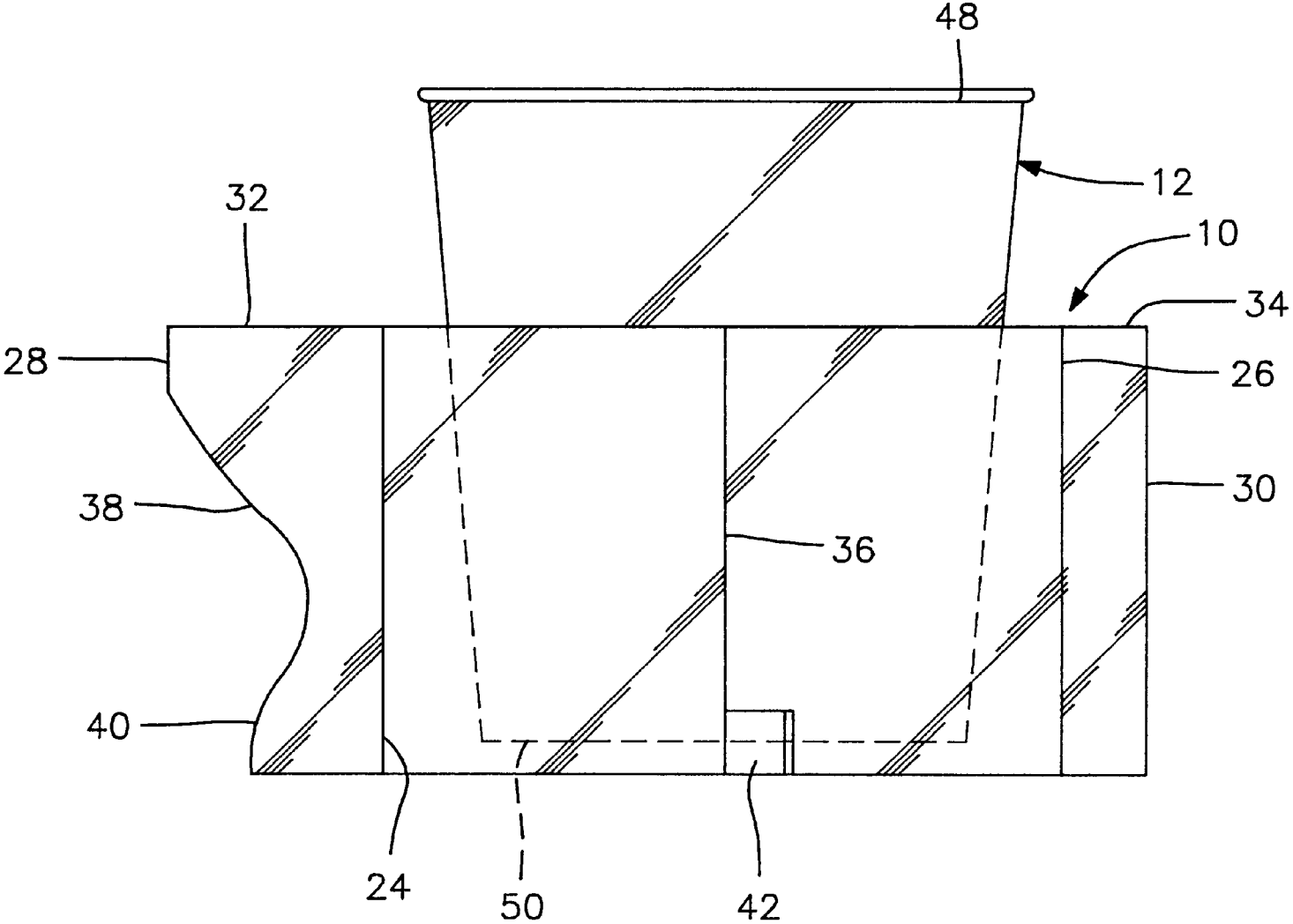
FIG. 3 is a side elevational view of the cup holder in which the cup has been inserted illustrating the side edges of the folded blank moved toward each other to open the slit at the upper end of the cup holder with the cup being inserted bottom first.
Figure 4:
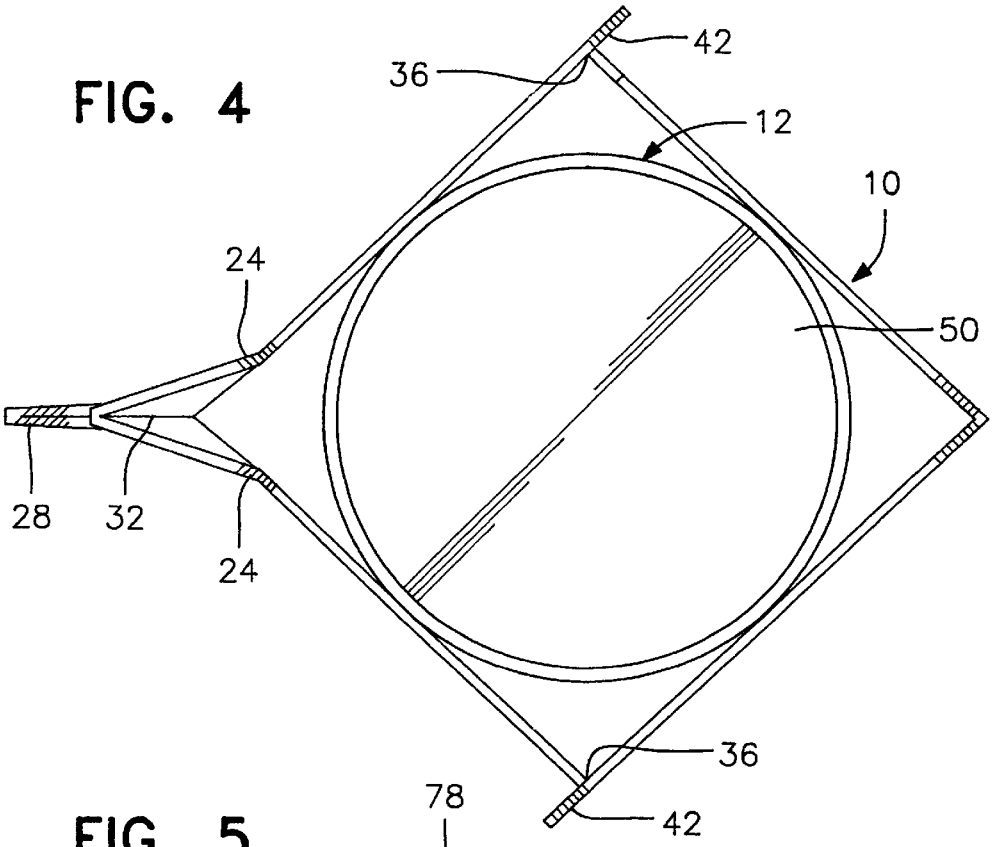
FIG. 4 is a bottom plan view of the cup holder and cup illustrating the relationship of the lower edge of the cup holder and the bottom periphery of the cup.

Referring to FIGS. 1–4 of the drawings, the cup holder 10 and its association with a cup 12 is illustrated in FIGS. 3 and 4. FIGS. 1 and 2 illustrate the blank 14 from which the cup holder 10 is formed.

The blank 14 is a generally rectangular, planar panel 16 constructed of cardboard, corrugated cardboard or similar material. A centrally disposed transverse slit or cut line 18 is formed in the center of the panel 16 between the end edges 20 and 22. The slit 18 forms the top edges of the cup holder 10. The slit 18 terminates at longitudinal fold lines 24 and 26 oriented inwardly from the side edges 28 and 30. The slit 18 defines the top edges of the cup holder and each side edge portion of the panel 14 includes a transverse fold line 32 and 34 forming an extension of the ends of the slit 18. A central fold line 36 parallel to the fold lines 24 and 26 extend from the center of the slit 18 to the edges 20 and 22 of the blank as illustrated in FIG. 1. The side edge 30 of the panel 16 is straight whereas the side edge 28 is provided with a pair of notches or recesses 38 which are identical in shape and size on each side of the fold line 32. Also, the notches or recesses 38 include an outer end portion 40 which has less width than the portion adjacent the fold line 32. Also, the panel 16 is provided with a tab 42 on opposite sides of the fold line 36 at the edges 20 and 22 of the blank. The tabs 42 are formed by a right angular cut line 44 associated with the fold lines 36 so that the tabs will project outwardly from the cup holder when folded in a manner to receive the cup 12.

As illustrated in FIG. 2, the blank 14 has been folded along fold lines 32 and 34 with the two halves of the blank being oriented in overlying matching relationship. The opposite side edges 30 and 28 of the folded blank illustrated in FIG. 2 are grasped between the thumb and one finger and the side edges are moved inwardly at the same time that the portions of the panel 16 between the fold lines 36 and 36 angulate about fold lines 24 and 26 as illustrated in FIGS. 3 and 4 thus forming a sleeve for receiving the tapered peripheral wall 46 of the cup 12 which includes a top lip 48 and a bottom end 50 of less diameter than the top lip 48. The thumb and opposing finger can be engaged with the notches 38 in the side edge 28 and the outer edge of the side edge 30 and these edges of the folded blank are moved toward each other to open the slit 18 to form an opening through which the cup 12 can be inserted bottom first. When the folded blank is opened by moving the side edges 30 and 28 toward each other and the panel 16 defines a sleeve with generally straight side wall sections, the tabs 42 will project from the side walls to which they remain connected to increase the lateral dimension of the bottom edges 20 and 22.

The dimensional characteristics of the blank, the length of the slit, the length of the fold lines and the configuration of the side edges can vary to receive different size beverage cups or containers and facilitate gripping engagement of the cup holder and cup when consuming beverages from the beverage cup 12. Both side edges of the cup holder may be provided with recesses or both side edges may be straight. The bottom edges 20 and 22 of the blank increase the dimensional area that engages a supporting surface thereby enhancing the stability of the cup inasmuch as the surface area contacted by the cup support is substantially greater than the surface area that would be engaged by the bottom end of the cup which is spaced upwardly from the support surface a short distance depending upon the size characteristics of the cup holder and the cup with which it is associated.

It is pointed out that the side edges and fold lines 24 and 26 diverge downwardly inasmuch as the bottom edges of the side edge portions outwardly of the fold lines 24 and 26 are not connected while the upper ends of the side edge portions outwardly of fold lines 24 and 26 are connected by the fold lines 32 and 34 thus enabling the side edges outwardly of fold lines 24 and 26 of the cup holder to diverge downwardly to increase the surface area engaged by the cup holder when placed on a supporting surface. Also, the dimensional characteristics of the cup holder determine how far the edges of the slit 18 of the cup holder is spaced from the upper lip or rim 48 of the cup 12 and how far the bottom end 50 of the cup is spaced above the lower edge of the cup holder.

FIGS. 5–9 illustrate another embodiment of the cup holder generally designated by reference numeral 60 associated with a cup 62 having a top lip or rim 64 and a bottom rim or edge 66. This embodiment of the cup holder 60 is also formed from a planar blank 68 in which both side edges are the same with the material forming the blank being corrugated board, cardboard or other material that has insulating characteristics and includes substantial rigidity but is still flexible and constructed of recyclable material.

Figure 5:
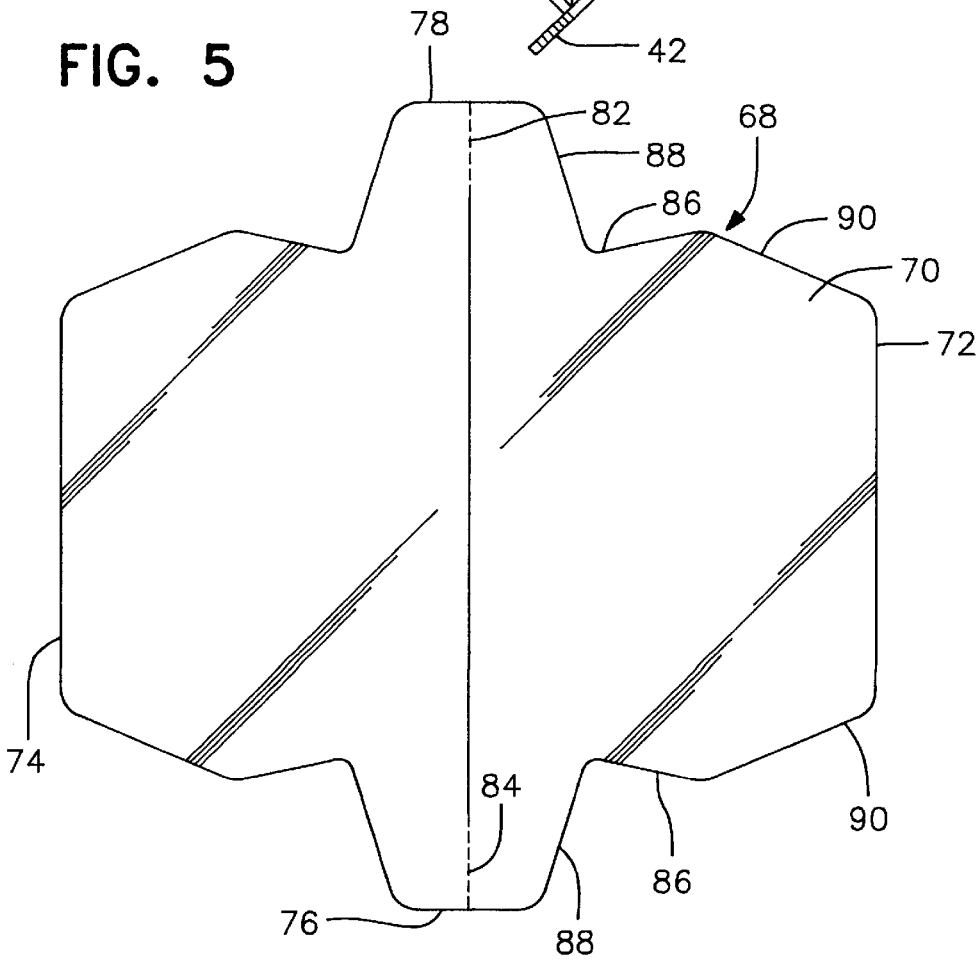
FIG. 5 is a plan view of a planar blank illustrating another embodiment of the cup holder.

The blank 68 includes a panel 70 having end edges 72 and 74 and side edges 76 and 78. A central slit 80 extends transversely at the center of the blank 70 with the ends of the slit terminating in short fold lines 82 and 84 which extend from the ends of the slit 80 to the side edges 76 and 78 as illustrated in FIG. 5. The end edges 72 and 74 which form the bottom edges of the cup holder 60 are shorter than the distance between the side edges 76 and 78. Each side edge 76 and 78 includes a recess 86 defined by an inclined edge portion 88 extending inwardly in diverging relation to the fold line 84 and the other end of the edge 88 is spaced from the fold line 84. This structure is the same on both side edges of the blank. The recess 86 is connected to the adjacent end edge by an inclined edge 90. The blank 68 is symmetrical on both sides of the slit 80 and fold lines 82 and 84 so that when the blank 68 is folded to the position illustrated in FIG. 6, the two halves of the blank 68 are exact duplicates and overlie each other.

Figure 6:
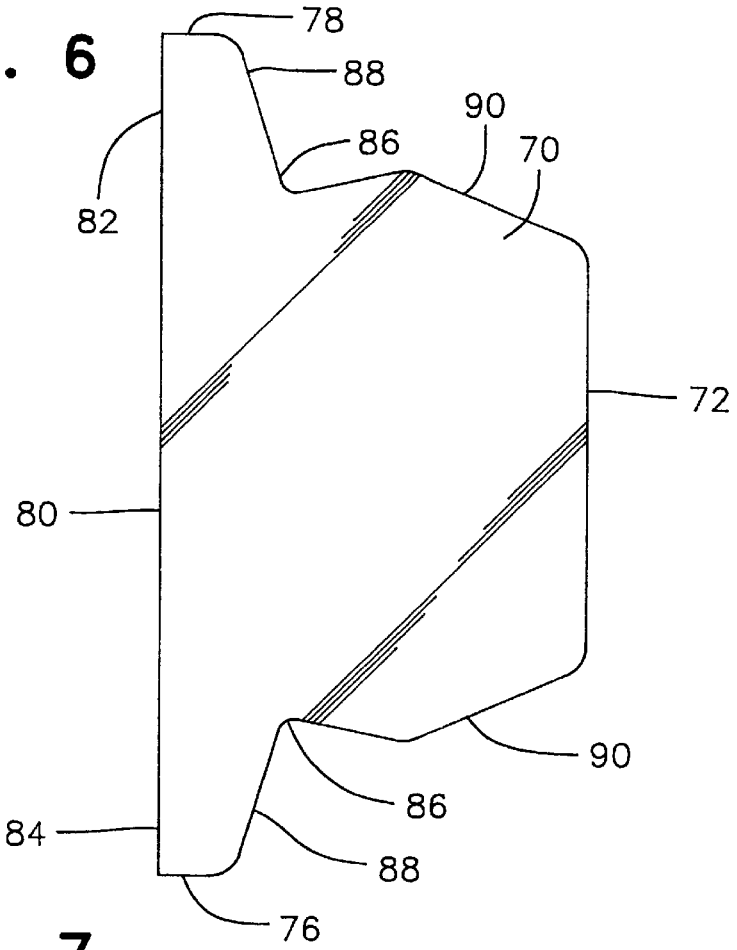
FIG. 6 is a plan view of the blank of FIG. 5 folded along a center line.
Figure 7:
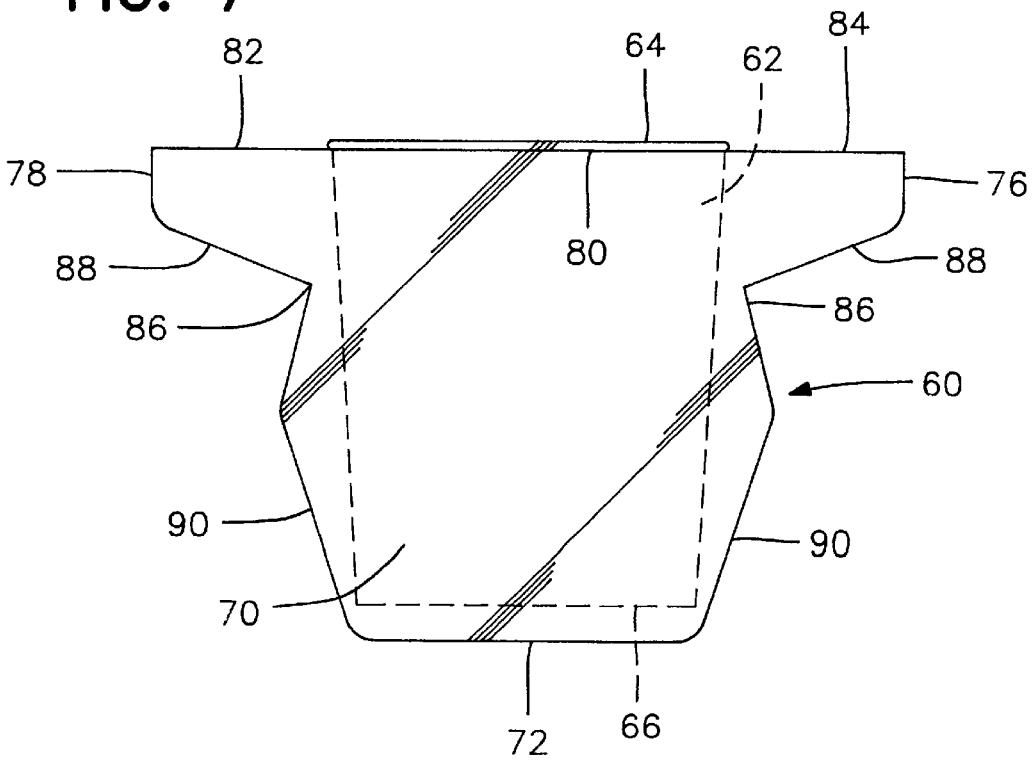
FIG. 7 is a side elevational view of the cup assembled in the cup holder.
Figure 8:
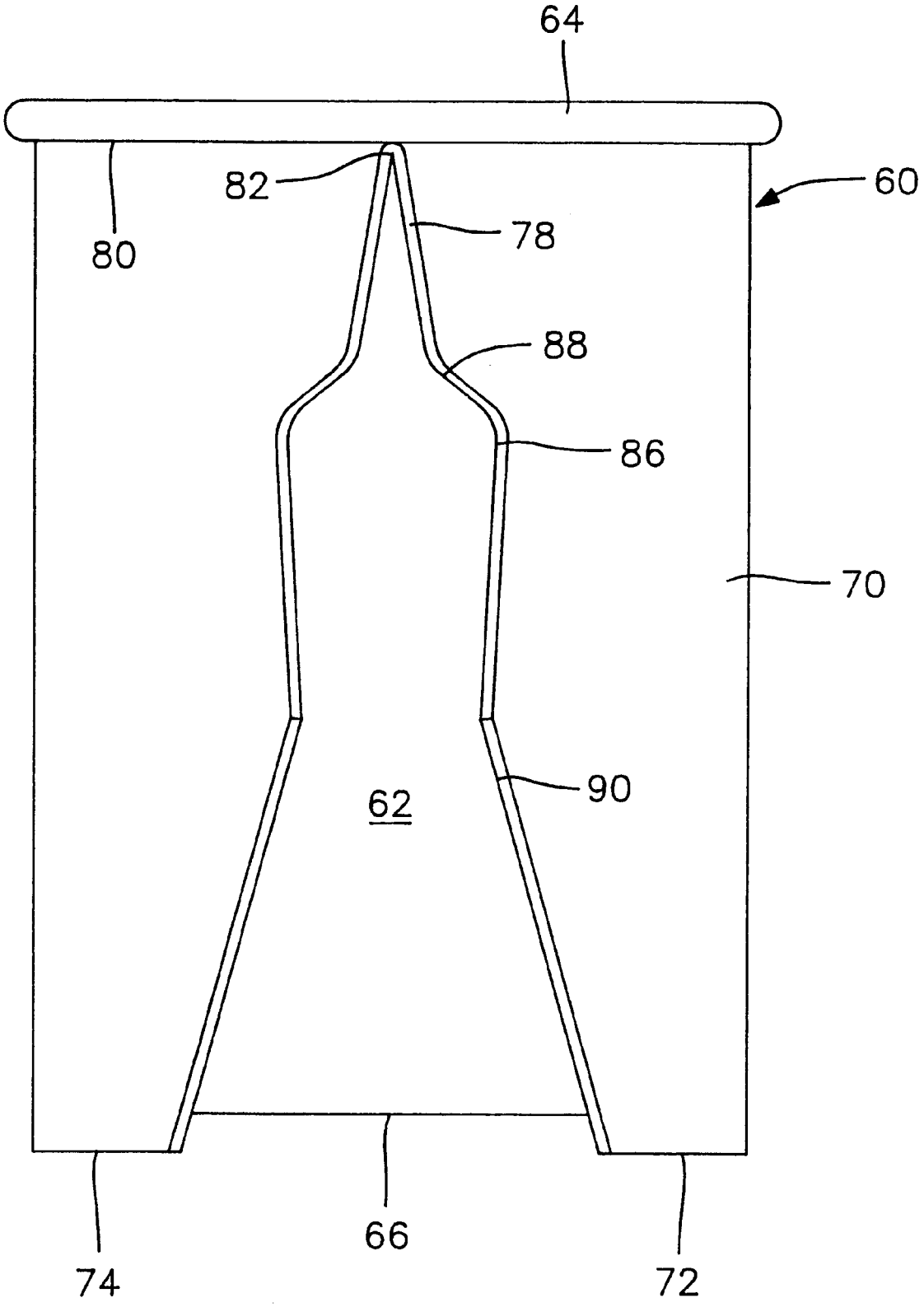
FIG. 8 is an end elevational view of the cup and cup holder of FIG. 7 illustrating the relationship between the cup and cup holder.
Figure 9:
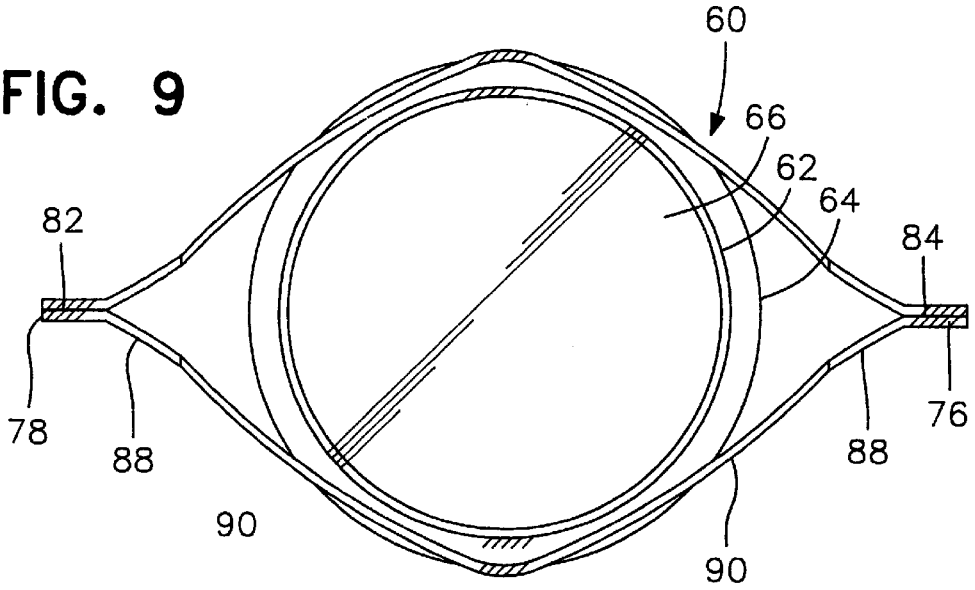
FIG. 9 is a bottom plan view of the cup and cup holder of FIG. 7 illustrating the relationship between the bottom of the cup and the cup holder.

When the folded blank 68 as illustrated in FIG. 6 is opened to form a sleeve, the thumb and an opposed finger engage the recesses 86 and move the side edges of the folded blank toward each other so that the central portions of the slit 80 move apart to enable insertion of the container 62 by inserting the bottom 66 downwardly through the opening defined by the slit 80 in a manner illustrated in FIGS. 7–9.

In this construction, the blank may be constructed of corrugated material with the facing sheet either inwardly and/or outwardly oriented with the facing sheet or sheets and/or corrugations being provided with shallow fold lines to enable symmetrical opening of the folded blank to receive the cup 62. Since the only connection between the two halves of the cup holder is along the fold lines 82 and 84, the bottom edges 72 and 74 of the cup holder are spaced outwardly from the periphery of the bottom edge 66 of cup 62 when the cup 62 and cup holder 60 are supported on a surface as illustrated in FIG. 8 to stabilize the cup and cup holder. The bottom edges 72 and 74 are also spaced below the bottom edge 66 of the cup 62 to further enhance stability. The weight of the cup 62 and its contents tend to cause the bottom edges of the cup holder to spread apart to move the slit edges against the periphery of the cup. The rim 64 of the cup may engage the edges of the slit 80 as long as the bottom edge 66 is spaced above the bottom edges 72 and 74 of the cup holder. This increased lateral dimensions of the edges 72 and 74 stabilizes the cup when placed on a supporting surface. However, the pivotal connection between the halves of the cup holder along the fold lines 82 and 84 enable opposed side surfaces of the cup holder between the free diverging edges 90 to be easily grasped and squeezed into firm surface-to-surface contact with the periphery of the cup 62. Upon release of the cup holder, the bottom edges 72 and 74 will normally spread apart to a position laterally spaced from the bottom end 66 of the cup 62 as shown in FIGS. 8 and 9.

Figure 10:
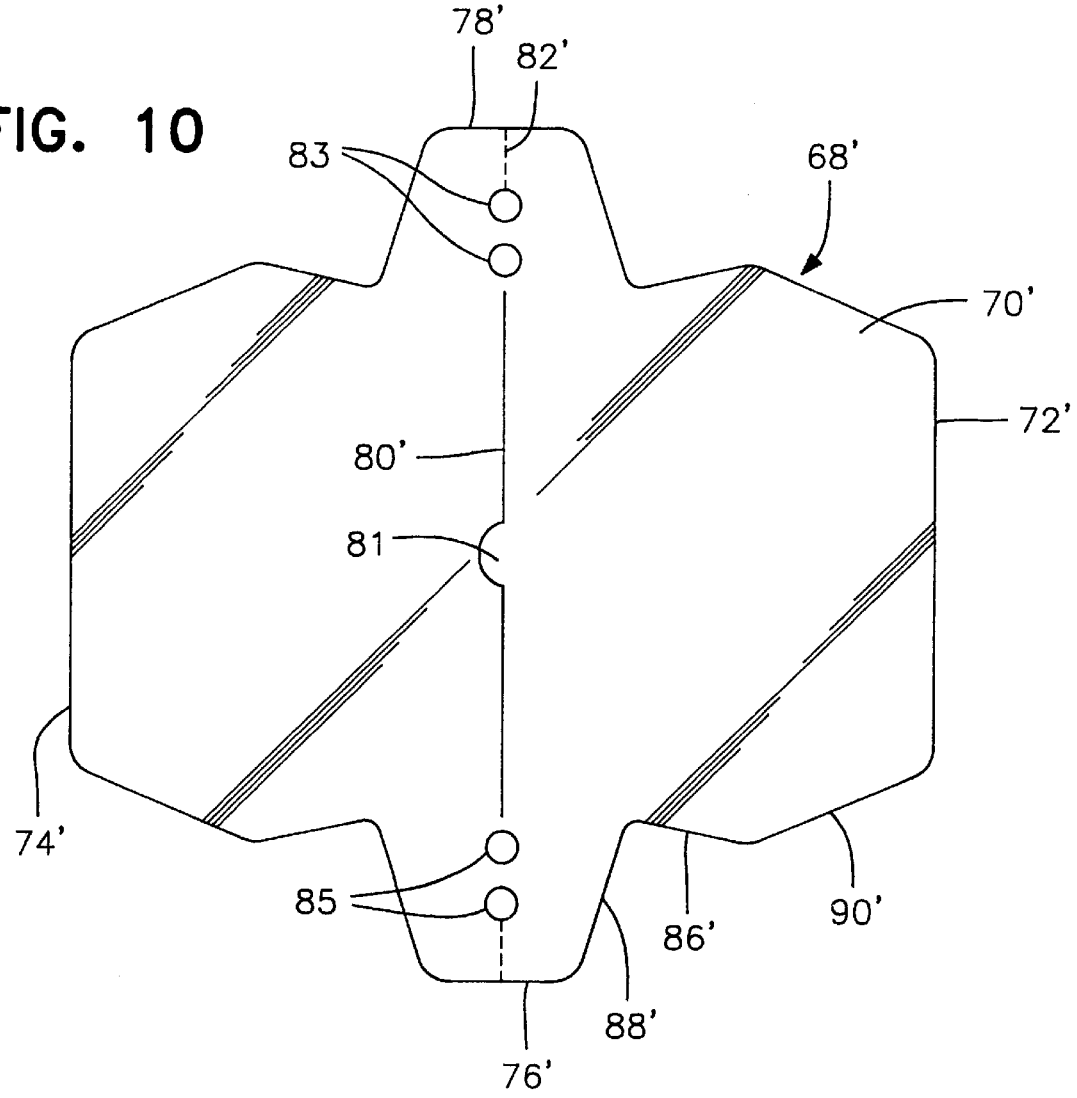
FIG. 10 is a plan view of another embodiment of the cup holder illustrating a tab to facilitate opening the transverse slit and material weakening openings defining the fold line outwardly of the ends of the slit.

FIG. 10 is a plan view of a slightly modified embodiment of the cup holder illustrated in FIGS. 5–9 as designated by reference 60'. In this construction, the cut line 80' is provided with a tab 81 of generally semi-circular construction at the center of the cut line or slit 80' to facilitate opening of the slit 80'. Also, an opening or a plurality of openings 83 and 85 to help define the fold lines 82' and 84'. The remainder of the cup holder 60' illustrated in FIG. 10 remains the same as that in FIGS. 5–9 and includes the same reference numerals which have been primed.

When corrugated cardboard is used, either single faced or double faced with the single face on either the inner surface or the outer surface, the corrugations extend lengthwise of the blank such as between the edges 72 and 74 so that when the cup holder receives the cup, the corrugations extend from the top of the cup toward the bottom. This facilitates the cup holder curving or bending at shallow fold lines to conform generally with the configuration of the peripheral wall of the cup. The blank, the central slit in the blank and the fold lines as well as the slits 44 which form the tabs 42 are formed in a conventional manner well known in the art. Glue is not used when making or using the cup holder which simplifies and reduces the cost of manufacture. Also, the absence of glue eliminates failure of glued surfaces during insertion of the cup into the holder and during use of the holder. The blanks are transported, stored and handled while in a flat condition and can be easily assembled with respect to the beverage cup or container by the beverage consumer or by an individual who sells the beverage or supplies the beverage to the consumer without requiring a high degree of manual dexterity thus enabling the cup or container as well as the cup holder to be completely recyclable.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A beverage cup holder comprising a sleeve including a pair of panels adapted to extend from an upper lip portion of a beverage cup downwardly alongside a peripheral wall of the beverage cup and terminating below a bottom of the beverage cup to support the beverage cup from a support surface, upper edges of said panels including outwardly extending components at opposite end portions thereof, said outwardly extending components being pivotally connected enabling a lower portion of said panels to diverge outwardly to engage a support surface over an area larger than a bottom of the beverage cup to stabilize the cup when supported by the cup holder on a support surface, said panels generally enclosing the peripheral wall of the cup and insulating the hand of a beverage consumer from temperature differences of the cup when a beverage consumer grasps the cup holder and cup when consuming products from the cup.

2. The cup holder as defined in claim 1, wherein said panels are each constructed of material capable of flexing with the top edges of the panels adapted to engage and conform with the beverage cup with diverging movement of lower ends of the panels biasing the upper edges of the panels inwardly for frictional engagement with a cup.

3. The cup holder as defined in claim 1, wherein said panels are constructed of one-piece of stiff but flexible cellulosic material to enable recycling of the cup holder.

4. The cup holder as defined in claim 3, wherein said panels are constructed of corrugated cardboard having corrugations extending lengthwise of the panels for enabling the panels to flex and conform with the cross-sectional configuration of a beverage cup.

5. The cup holder as defined in claim 3, wherein the outwardly projecting ends of the upper edges of the panels are pivotally connected by a fold line formed integrally with the panel material.

6. The cup holder as defined in claim 5, wherein at least one of said outwardly projecting ends of the upper edges includes an inclined lower edge extending back toward a center of the cup holder to provide a downwardly facing projecting edge adapted to engage an upper surface portion of the hand of a person gripping the cup and cup holder.

7. The cup holder as defined in claim 5, wherein each of said projecting ends of the upper edges of the panels includes a lower inwardly extending edge to define downwardly facing surfaces adapted to engage upper surface portions of the hand of a person gripping the cup holder and cup.

8. The cup holder as defined in claim 1, wherein each of said panels include a central longitudinal fold line and a pair of edge longitudinal fold lines disposed inwardly from the edges of the panels with the pivotal connection between the outwardly projecting ends of the upper edges of the panels being disposed outwardly of the side fold lines, said fold lines enabling the panels to be folded into a generally square configuration with the top edges of the square configuration adapted to engage under an upper lip of a beverage cup.

9. The cup holder as defined in claim 8, wherein the side edges of the panels below the pivotally connected laterally projecting ends of the upper edges being free to diverge downwardly.

10. The cup holder as defined in claim 8, wherein the bottom ends of each panel include an outwardly extending tab coincident with the lower end of the central fold line to extend laterally outwardly from the lower end of the cup holder to further enlarge the area of a support surface engaged by the cup holder.

11. The cup holder as defined in claim 1, wherein said panels are of one-piece construction with the side edge portions below the pivotally connected upper end portions diverging and being free of each other to enable diverging movement of the panels when the upper edges thereof engage and support an upper end of a cup with downward forces exerted by the cup and product therein causing the lower ends of the panels to diverge outwardly to increase the area of the support surface engaged and increase the gripping engagement with a beverage cup.

12. The cup holder as defined in claim 1, wherein said panels are of one-piece cellulosic construction formed as a planar blank having a central transverse slit and a fold line extending outwardly from each terminal end of the slit, said fold lines being the sole connection between said panels and enabling the two panels to be folded about the fold lines and the side edges of the panels moved inwardly towards each other to cause the edges of the slit to deflect outwardly without the use of glue to define an opening adapted to receive a beverage cup inserted therein bottom first.

13. The cup holder as defined in claim 12, wherein said fold line outwardly of each terminal end of the slit includes at least one opening defining a weakened area to facilitate pivotal movement of the panels about the fold lines.

14. The cup holder as defined in claim 12, wherein a central area of said slit includes a tab formed thereon to facilitate movement of the edges of the slit away from each other when the panels are pivoted from a planar position to a converging position and the side edges of the panels are moved toward each other to open the slit.

15. The cup holder as defined in claim 1, wherein said panels forming said sleeve are of one piece construction thereby eliminating the use of glue, a glue applying step during manufacture and the necessity of manipulating connecting components requiring manual dexterity when the cup holder and cup are assembled.

16. A blank for forming a cup holder comprising a planar panel having spaced opposed end edges and spaced opposed side edges, a transversely extending slit located centrally between said end edges, said slit terminating in ends spaced inwardly from said side edges, a transverse fold line extending between each end of said slit and an adjacent side edge of said panel, longitudinal extending flexible areas extending from a central area of edges of said slit to said end edges of the panel, and longitudinal flexible areas extending from each terminal end of said slit to enable panel halves to be folded about said fold lines into overlying relation and enabling longitudinal central areas of the panel halves to be displaced outwardly along said longitudinal flexible areas extending longitudinally from the central area of each edge of the slit and the longitudinally extending flexible areas extending from each terminal end of said slit by displacing the side edges of the panel halves towards a longitudinal center of the panel by manual gripping engagement to form a sleeve having a longitudinal opening between central areas of the slit to enable a cup to be inserted bottom first into the sleeve with the edges of the slit engaging and supporting a peripheral external lip at an upper end of the cup.

17. The blank as defined in claim 16, wherein the panel halves diverge from said fold lines and extend beyond a bottom edge of the cup in peripherally spaced relation to insulate the cup from a hand gripping the cup holder and stabilize the cup and cup holder when placed on a supporting surface.

* * * * *